US010448799B2

(12) United States Patent
Klimis et al.

(10) Patent No.: US 10,448,799 B2
(45) Date of Patent: Oct. 22, 2019

(54) SPONGE HAVING AN OPEN CAVITY

(71) Applicant: EURVEST, Braine L'Alleud (BE)

(72) Inventors: Pierre Klimis, Ohain (BE); Alain Luciani, Auriol (FR); Calude Mancel, Waterloo (BE); Dominique Thiebaud, Waterloo (BE)

(73) Assignee: EURVEST, Braine L'Alleud (BE)

( * ) Notice: Subject to any disclaimer, the term of this patent is extended or adjusted under 35 U.S.C. 154(b) by 0 days.

(21) Appl. No.: 14/399,439

(22) PCT Filed: Mar. 15, 2013

(86) PCT No.: PCT/EP2013/055491

§ 371 (c)(1),
(2) Date: Nov. 6, 2014

(87) PCT Pub. No.: WO2013/167304

PCT Pub. Date: Nov. 14, 2013

(65) Prior Publication Data

US 2015/0096595 A1 Apr. 9, 2015

(30) Foreign Application Priority Data

May 10, 2012 (FR) ..... 12 54301
Dec. 21, 2012 (FR) ..... 12 62734

(51) Int. Cl.
*A47L 13/16* (2006.01)
*A47K 5/14* (2006.01)
(Continued)

(52) U.S. Cl.
CPC ..... *A47L 13/16* (2013.01); *A47K 5/14* (2013.01); *A47K 7/03* (2013.01); *A47L 13/17* (2013.01); *A47L 17/08* (2013.01)

(58) Field of Classification Search
CPC ..... A47L 13/16; A47L 13/17; A47K 7/03
See application file for complete search history.

(56) References Cited

U.S. PATENT DOCUMENTS 3,114,928 A * 12/1963 Spiteri ..... A47K 7/03 401/201
3,613,959 A * 10/1971 Mason ..... A47L 15/4418 134/95.1

(Continued)

FOREIGN PATENT DOCUMENTS

EP 1634524 3/2006
FR 2867053 9/2005

OTHER PUBLICATIONS

FR2867053; Le Guin, A.; 2005; machine translation.*

*Primary Examiner* — Mikhail Kornakov
*Assistant Examiner* — Natasha N Campbell
(74) *Attorney, Agent, or Firm* — Duane Morris LLP; Gregory M. Lefkowitz; Jason M. Nolan

(57) ABSTRACT

The present invention relates to a sponge (20) including at least one cavity (22), distinct from the pores of the sponge 5 (20), capable of allowing the introduction of a liquid inside the sponge (20) to impregnate the sponge (20), the cavity (22) preferably having a bottom (24) inside the sponge (20), and emerging on the other hand on a surface (26) of the sponge (20) while forming an opening (28) such that the maximum distance between two points of the contour of the opening (28) is comprised between 3, preferably 5, still more preferably 8, and 25, preferably 20, still more preferably 15 mm or still more preferably 12 mm.

24 Claims, 2 Drawing Sheets

(51) Int. Cl.

| | |
|---|---|
| ***A47L 13/17*** | (2006.01) |
| ***A47L 17/08*** | (2006.01) |
| ***A47K 7/03*** | (2006.01) |

(56) References Cited

U.S. PATENT DOCUMENTS

| | | | | |
|---|---|---|---|---|
| 8,061,919 | B2 * | 11/2011 | Alarcon Grajeda | A47K 7/03 15/244.4 |
| 2003/0077106 | A1 | 4/2003 | Weihrauch | |
| 2004/0229763 | A1 * | 11/2004 | Hutton, III | B05B 7/0037 510/220 |
| 2007/0010680 | A1 * | 1/2007 | Yajima | A61K 8/42 554/51 |
| 2011/0239394 | A1 * | 10/2011 | Pisacane | A47K 7/02 15/244.4 |
| 2012/0077010 | A1 * | 3/2012 | Manesis | B29C 67/20 428/220 |

* cited by examiner

SPONGE HAVING AN OPEN CAVITY

CROSS-REFERENCE TO RELATED APPLICATIONS

This application is a § 371 national stage entry of International Application No. PCT/EP2013/055491, filed Mar. 15, 2013, which claims priority to French Patent Application No. 1254301, filed May 10, 2012, and French Patent Application No. 1262734, filed Dec. 21, 2012, the entire contents of which are incorporated herein by reference.

FIELD OF THE INVENTION

The present invention relates to the field of cleaning surfaces, and more particularly sponges. The sponges according to the present invention have the advantage of optimizing the performance and quantity of liquid detergent used during cleaning by directly impregnating the inside of the sponge. Furthermore, the user can easily refill the sponge during the cleaning phase while dosing the quantity of liquid applied.

TECHNOLOGICAL BACKGROUND OF THE INVENTION

It is known to use a sponge associated with a detergent product to clean surfaces, such as floors, windows, or kitchen items and dishes.

In the case of cleaning dishes in particular, the cleaning is done in a basin, or more commonly under running water. In fact, given that standing water containing the dishwashing liquid becomes dirty quickly and hinders cleaning, many users prefer washing dishes under running water. However, this type of cleaning requires the regular application of dishwashing liquid.

During the cleaning phase, there is a so-called "direct application" technique consisting of depositing the detergent product directly on the dish to be cleaned or on the surface of the sponge that will be in contact with the dish items before cleaning them. The porosity of the sponge makes it possible to retain part of the detergent liquid in the sponge. However, a substantial quantity of detergent liquid is frequently lost before being used. Furthermore, the absorption of the detergent liquid in the sponge depends on the material of the sponge.

The pressure exerted by the user on the moistened sponge, combined with the porosity of the sponge, causes the creation of foam. The quantity of foam created also depends on the structure of the sponge. This foam is the visual indicator for a user that product is present in the sponge and therefore indicates the cleaning power. Thus, the less foam that is created, the more the user is inclined to resupply the sponge with detergent product.

An overdose of the detergent product by the user may thus occur. The structure of the sponge is therefore an important factor in the consumption of soap product by the user.

One known type of sponge is made up of a single absorbent layer. When the user places detergent product on the sponge, said product partially penetrates the inside of the sponge since it is only impregnated on the surface, i.e., over a small thickness of sponge.

After a short use, in particular under running water, the detergent product is exhausted, foam generation becomes low, and the user is quickly motivated to resupply the sponge. This type of sponge therefore creates unsatisfactory overconsumption of detergent product.

Another known type of sponge is the so-called "multi-layer" sponge. This type of sponge include several layers stacked on top of one another. The layers may be made up of different materials to increase the versatility of the sponge. Thus, there is a so-called "dual-layer" sponge made up of an absorbent layer stacked with a scouring or abrasive layer. Such sponges are for example marketed under the Scotch Brite® brand.

There is also a so-called "three-layer" sponge made up of an absorbent layer positioned between upper and lower layers that may have complementary functions, for example scouring and/or abrasive, cleaning or wiping.

However, users frequently resupply a multi-layer sponge, applying detergent liquid directly on the surface designed to be in contact with the surface to be cleaned, i.e., the abrasive or scouring layer, before continuing cleaning. However, the abrasive or scouring layers have a low porosity, or even a nonexistent porosity, which limits the penetration of the detergent product in the sponge accordingly. This causes the elimination of a large portion of the product when the sponge is put in contact with water, in particular when it is used under running water, and also causes significant overconsumption of detergent liquid.

In the prior art, another type of dishwashing sponge also exists including an ergonomic sleeve filled with detergent liquid fixed on the upper face of the sponge that continuously supplies the sponge with detergent liquid. For example, such products are marketed under the Dawn® brand. However, the continuous supply saturates the sponge continuously and also creates unacceptable overconsumption of product. This type of product also has the drawback of limiting the available cleaning surface on the surface where the sleeve is glued. More particularly, this type of sponge has the additional drawback of being very expensive and difficult to produce. It is desirable, however, for cleaning products to be as inexpensive as possible and easy to produce, since they are designed to be replaced regularly.

Among this type of sponge, some have a vertical through hole allowing part of the detergent liquid from the sleeve to be applied directly on the dish to be cleaned and on the scouring part. This therefore results in the same drawbacks as the use of multi-layer sponges.

Furthermore, known from EP-A-0 066 463 is a sponge containing a detergent before use of the sponge by the user. This sponge include several layers stacked on one another. Compartments are formed between the layers to allow the storage of detergent inside the sponge. The sponge also includes conduits allowing soap to leave the compartments toward the outside of the sponge. The conduits have a diameter smaller than 1.2 mm, to allow detergent to exit only in the event of pressure exerted on the sponge by the user. The cavity of the sponges according to the invention differs from the sponges described in EP-A-0 066 463 not only by the dimensions, but also by its function. In document EP-A-0 066 463, the conduits aim to allow the release of dishwashing product from the inside of the sponge toward a free surface of the sponge.

Patent application FR-A-2 867 053 also describes a block, which is provided with a through opening on a reservoir compartment designed to distribute a product on the working surface through the opening. However, the product introduced does not impregnate the inside of sponge and can be rinsed off.

In patent application EP-A-1 634 524, a sponge comprising an opening is also described. However, the purpose of the opening is to create foam on a localized part of the sponge only and the liquid introduced does not impregnate the inside of the sponge. Furthermore, the structure of the sponge is complex to produce, since it involves the individual use of several elements that must be assembled together.

Document EP-A-1 261 468 describes a method for manufacturing a sponge with a compartment made by molding and whereof the structure, which is complex, is not suitable for a consumer product. Furthermore, the complex shapes of the sponges require the use of rigid materials that are not desirable for foam generation.

The aim of the present invention is to overcome all of the drawbacks of the prior art by providing a sponge that is easy to manufacture, allowing the user to refill it during the cleaning phase using a visual indicator. The present invention makes it possible to save on detergent product while offering an optimal cleaning surface and better foaming and detergent power.

BRIEF DESCRIPTION OF THE INVENTION

Figure 1:
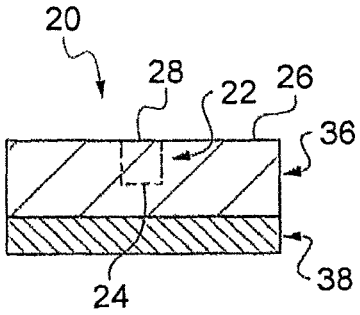
FIGS. 1 to 6 show a cross-section of sponges according to the present invention, showing one or more cavities of the sponge.

A first aspect of the invention relates to a sponge (20) including at least one cavity (22), distinct from the pores of the sponge (20), capable of allowing the introduction of a liquid inside the sponge (20) to impregnate the sponge (20), the cavity (22) preferably having a bottom (24) inside the sponge (20), and emerging on the other hand on a surface (26) of the sponge (20) while forming an opening (28) such that the maximum distance between two points of the contour of the opening (28) is comprised between 3, preferably 5, still more preferably 8, and 25, preferably 20, still more preferably 15 mm or still more preferably 12 mm.

According to another embodiment of the invention, the sponge can be impregnated by at least 10%, at least 30%, at least 50%, at least 75% or at least 90% of the volume of the liquid introduced into the cavity inside its structure; for example, a liquid whereof the viscosity is comprised between 10 and 10,000 centipoises, between 200 and 3,000 centipoises or between 300 and 2,000 centipoises at 25° C.

According to one embodiment of the invention, all of the faces of the sponge are cleaning and/or foam-generating.

According to another embodiment of the invention, the sponge has no reservoir sleeve.

According to one embodiment of the invention, the cavity has a bottom (24) inside the sponge, in particular when the cavity is perpendicular to at least one of the main faces of the sponge.

According to another embodiment of the invention, the opening (28) of the sponge has a surface area comprised between 5 and 200 $mm^2$, preferably comprised between 20 and 120 $mm^2$ and still more preferably between 50 and 120 $mm^2$ or between 50 and 100 $mm^2$.

According to another embodiment of the invention, the contour of the opening (28) is circular, oval or rectangular.

According to another embodiment of the invention, the cavity has a constant cross-section corresponding to that of the opening, and is preferably cylindrical.

According to another embodiment of the invention, the cavity is a through cavity along an axis not perpendicular to one of the main faces of the sponge, preferably parallel to one of the main surfaces of the sponge.

According to another embodiment of the invention, the inner volume of at least one of the cavities (22), or, if applicable, the cumulative inner volume of the cavities (22), is comprised between 1 and 6 $cm^3$, preferably between 1.2 and 4 $cm^3$, and still more preferably between 1.2 and 2 $cm^3$.

According to another embodiment of the invention, the opening (28) of the cavity (22) is situated on at least one of the side faces of the sponge or on the upper surface when the cavity comprises a bottom (24).

According to another embodiment of the invention, at least part of the sponge (20) is made from a porous material and also includes closed pores, preferably between 2 and 20%, and still more preferably between 3% and 5% closed pores.

According to another embodiment of the invention, at least part of the sponge is hydrophilic.

According to another embodiment of the invention, the absorption speed of a reference volume of 2 mm of a liquid with the viscosity of 900 cps at 25° C. deposited on the surface of the sponge previously moistened with 140 $cm^3$ of sponge is less than 5 minutes, preferably less than 3 minutes, and still more preferably less than 2 minutes.

According to another embodiment of the invention, the first layer (36) is made from a deformable material, preferably a foam, and still more preferably, a polyurethane foam.

According to another embodiment of the invention, the sponge also includes a second layer (38) glued on at least part of the lower surface of the sponge (36).

According to another embodiment of the invention, the sponge includes a third layer (42) glued on at least part of the upper surface of the sponge (36), the second and third layers (36, 38, 42) characterizing a "sandwich" structure and whereof the second and third layers optionally offer a different function of the sponge (20).

According to another embodiment of the invention, the opening (28) is situated on the third layer (42) and the cavity (22) passes through said third layer.

According to another embodiment of the invention, the second layer (38) and/or the third layer (42), if applicable, are made from an abrasive material.

According to another embodiment of the invention, the second layer (38) and, if applicable, the third layer (42) are made from cellulosic sponge, cellulosic tissue, hydrophilic polyurethane foam, an open pore honeycomb material, a hydrophilic honeycomb material, a honeycomb material with a base of a vinyl acetate polymer, a cellulose-based material, melamine foam or fiber-based material, preferably microfibers.

According to another embodiment of the invention, the second layer is made from an abrasive material and the third layer is made from a microfiber-based material.

According to another embodiment of the invention, part or all of the first, second and third layers (36, 38, 42) is glued using an impermeable glue, preferably polyurethane-based glue.

According to another embodiment of the invention, the sponge (20) comprises a cavity (22), distinct from the pores of the sponge (20) and emerging on a surface (26) of the sponge (20) while forming an opening (28), obtained by removing material in the sponge (20), preferably by drilling, boring, incision or milling.

According to another embodiment of the invention, the sponge (20) can be refilled during use with a constant and predetermined quantity of liquid, smaller than the saturation quantity of the sponge.

A second aspect of the invention relates to a method for manufacturing a sponge (20) according to the invention comprising removing part of the material of the sponge to form the cavity (22).

A third aspect of the invention relates to a cleaning method in which a user manipulates a sponge (20) according to the invention and releases a quantity of cleaning liquid by compressing said sponge (20).

According to another embodiment of the invention, the user reloads the sponge (20) with a cleaning liquid during the cleaning phase.

According to another embodiment of the invention, the method is implemented under running water.

According to another embodiment of the invention, the cleaning liquid is a detergent liquid, a degreasing liquid or a dishwashing liquid, preferably a dishwashing liquid.

A fourth aspect of the invention relates to a method for filling a sponge (20) according to the invention in which the user introduces a constant volume of liquid in the cavity (22) of the sponge (20).

According to another embodiment of the invention, the tip of the bottle containing the liquid is inserted directly into the opening.

According to another embodiment of the invention, the tip of the liquid bottle creates a hermetic contact area with the cavity of the sponge, in particular by deforming the opening during the insertion of the tip of the liquid bottle.

A fifth aspect of the invention relates to the use of the sponge according to the invention, in particular to clean dish items.

A sixth aspect of the invention relates to a kit comprising a sponge according to the invention and printed user instructions and/or illustrations.

According to another embodiment of the invention, the instructions and/or illustrations indicate the number of plates, glasses or pans that can be cleaned depending on the volume of the filling opening of the sponge (20).

According to another embodiment of the invention, the kit comprises an indication on the type of dishwashing liquid and/or bottle to be used with the sponge (20).

According to another embodiment of the invention, the kit also comprises a bottle of dishwashing soap.

DETAILED DESCRIPTION OF THE INVENTION

In order to achieve the aforementioned aim, the present invention proposes a sponge including at least one cavity, distinct from the pores of the sponge, making it possible to introduce a given quantity of detergent liquid inside the sponge to impregnate it, the cavity preferably having a bottom inside the sponge, and emerging on the other hand on a surface of the sponge.

According to the present invention, the term "detergent liquid" designates any cleaning liquid or gels that may be used in household cleaning or upkeep. These are for example degreasing liquids, detergents, dishwashing liquids, liquids containing enzymes, antibacterials or antiseptics. The term also refers to gels which, not being completely solid, are fluid enough to fill a cavity, be absorbed by the sponge and be released during the cleaning phase, for example using simple compression of the sponge by the user.

These types of liquids/gels generally correspond to products concentrated in a detergent agent; they generally have viscosities typically comprised between 10 and 10,000 centipoises, for example between 200 and 3,000 centipoises or between 300 and 2,000 centipoises at 25° C. Thus, the sponges according to the present invention are usable with different types of liquids currently marketed. One type of standard reference liquid soap is the dishwashing soap marketed under the Fairy® brand or Paic® brand.

According to the present invention, the term "sponge" refers to an absorbing, porous and/or fibrous, natural or synthetic, material used to clean surfaces or dishes. A sponge generally assumes the form of a rectangle having two main cleaning faces and four side surfaces. The so-called "main" faces offer the largest contact surfaces of all of the faces of the sponge. The term designates an item capable of being directly handled by the user. Generally, the dimensions of the sponge are such that the user can hold the sponge completely in his hand. Such a sponge may also have an ergonomic shape, for example a thin profile in the center thereof so as to be easier to grip, or may have side reinforcements capable of facilitating grasping of the sponge by the user. In particular, according to one preferred embodiment of the invention, the sponges exclude the presence of a reservoir sleeve, capable of containing a cleaning liquid reservoir.

The sponge according to the invention makes it possible to introduce detergent liquid inside the sponge. Furthermore, the sponge according to the invention can be impregnated by the introduced liquid, i.e., it allows a substantial quantity of the liquid introduced into the cavity to directly penetrate the inside of the structure of the sponge, i.e., to be absorbed. "Substantial" means at least 10%, at least 30%, at least 50%, at least 75% or at least 90% of the volume of the liquid introduced into the cavity after the sponge has optionally been moistened. Thus, the liquid is contained in the very structure of the sponge and comes out in the form of foam from all of the available surfaces of the sponge during cleaning. The entire structure of the sponge generates and then favors the formation of foam.

The sponge according to the invention in fact makes it possible to be able to be impregnated by the liquid before the latter leaves the cavity under pressure from the user. Advantageously, the sponge according to the invention makes it possible to be impregnated with liquid introduced into the cavity fairly quickly so that it does not come out during conventional handling of the sponge, i.e., in several minutes, for example in 5, 3 or 2 minutes.

The materials in the composition of the sponge making it suitable for impregnating the introduced liquid will be chosen by one skilled in the art depending on the considered usage and the nature of the liquid to be used.

By increasing the diffusion of the liquid in the sponge, the effectiveness of the active ingredients and additives generally comprised in the composition of the liquid, such as the enzymes, bactericides or fragrances, is improved.

Typically, the sponge has a density (unit weight) comprised between 18 and 40 $kg/m^3$ and preferably comprised between 20 and 30 $kg/m^3$. It may be adapted depending on the considered uses. An excessively low density may cause insufficient liquid retention, while an excessively high density may alter the flexibility as well as foam generation.

The porous material may include closed pores, or partially closed pores, preferably between 2 and 20% and still more preferably between 3 and 5% closed pores. In fact, a completely open porous structure—i.e., whereof the pores are open—facilitates the absorption of the dishwashing product, but does not enable the retention thereof. On the contrary, a completely closed pore structure—i.e., whereof all of the pores are closed—is sealed and rigid. Thus, a layer whereof only a portion includes closed pores or partially closed pores allows satisfactory impregnation and retention of the dishwashing product for economical consumption of the dishwashing product.

Furthermore, such a porous structure including only a portion of closed or partially closed pores makes it possible to increase foam generation. Advantageously, the sponge will in particular include pores with a mean diameter smaller than 1 mm to improve its foaming power. The quantity of foam formed may be assessed using the protocol presented in the examples below.

Advantageous sponge structures according to the invention offer a large absorption capacity and speed. For example, the absorption capacity is such that a volume of 2 ml of liquid having a viscosity of 900 centipoises at a temperature of 25° C., deposited on the surface of the previously-moistened sponge (2 cm thick and 70 $cm^2$ surface area), is absorbed in less than 5 minutes, preferably less than 3 minutes and still more preferably less than 2 minutes.

The material may also be hydrophilic to accelerate the impregnation of the dishwashing product in the sponge. It may for example be made up of a hydrophilic polyurethane foam, an open porous honeycomb material, a hydrophilic honeycomb material, a honeycomb material with a base of a vinyl acetate polymer, or a cellulose-based material, this list not being limiting.

Figure 2:
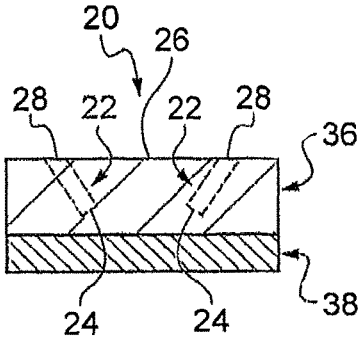
Figure 5:
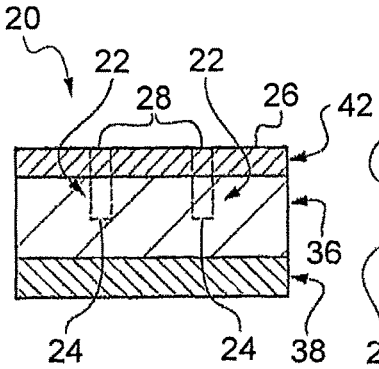
Figure 6:
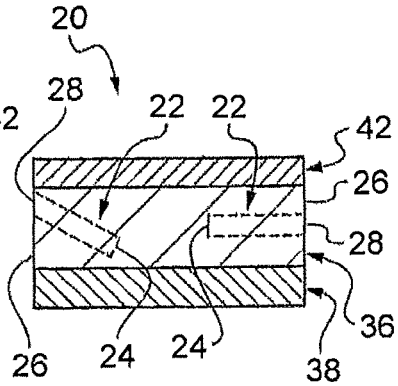

According to the present invention, the term "cavity" refers to any space created within the sponge that can be manufactured by removing material, such as a notch or hole. For example, the removal of material may be done by drilling, boring, incision or milling. Particularly, the cavity is made directly in the mass of the sponge and not by assembling elements where part of the material has previously been removed. Thus, the cavities are prepared according to methods that are easy to implement and that simplify the industrial production of the sponges relative to more complex cavity shapes and make it possible to decrease the production costs and therefore prices. The sponges according to the invention comprise one or more cavities as illustrated in FIG. 2, 5 or 6.

The cavities may also have a bottom, in particular in the case where one of the cavities is vertical relative to one of the main cleaning surfaces of the sponge, such that the detergent liquid can be absorbed in the heart of the sponge by the sponge and not directly released on the surface to be cleaned, through the sponge. The bottom is not, however, necessary when a through cavity is inclined relative to the vertical axis or parallel to one of the main cleaning surfaces. In fact, the liquid then has the possibility of being absorbed in the heart of the sponge by flowing along the wall of the cavity before exiting.

Advantageously, the cavity of the sponges according to the invention comprises a bottom. Typically, the inner volume of the cavity, or, if applicable, the cumulative inner volume of the cavities, is comprised between 1 and 6 $cm^3$, preferably between 1.2 and 4 $cm^3$, or between 1.2 and 2 $cm^3$. In the case of an application for dishwashing, this volume typically corresponds to the half-dose necessary for standard dishwashing, which makes it possible to perform a cleaning cycle with a single refill. In filling the cavity, the user has a visual indicator that makes it possible to fill the sponge systematically with a consistent volume of liquid soap and to dose the product economically during each refill. Furthermore, the cavity makes it possible to introduce the liquid soap directly into the heart of the sponge, which makes it possible to take advantage of the detergent and foaming effects of the full quantity of the added product without any loss. This was not the case with the sponges of the prior art, in particular when they were used under running water.

It is also possible to consider providing a specific cavity volume according to the properties of a particular type of liquid soap, for example depending on the concentration of liquid soap or its cleaning power for a given application.

The cavity opens on at least one of the surfaces of the sponge. Typically, the size and shape of the opening correspond to the cross-section of the through cavity so as to facilitate the production of the sponges according to the invention. The opening comprises a surface area typically comprised between 5 and 200 $mm^2$, preferably comprised between 20 and 120 $mm^2$, and still more preferably between 50 and 120 $mm^2$ or between 50 and 100 $mm^2$ so as to be able to directly receive the tip of liquid soap bottles.

The contour of the opening on the free surface is such that the maximum distance between two points of the contour of the opening is comprised between 3, preferably 5, still more preferably 8, and 20 mm, preferably 15 mm, still more preferably 12 mm. In other words, on all of the points of the contour, the maximum distance between two points of that contour is comprised between 3 and 20 mm. Advantageously, this opening size prevents the liquid introduced into the cavity by the user from leaving before it has impregnated the inside of the sponge.

Preferably, the opening has a surface slightly smaller than the size of the tip of the liquid soap bottle and deforms when the bottle is inserted into the opening so as to ensure hermetic contact with the tip of said bottle. This tightness may also be obtained by pressing the head of the bottle on the surface of the sponge situated around the opening. This alternative of the invention thus prevents any loss of detergent product during the refill. The user fills the cavity by pressing on the bottle and knows that the cavity has been filled when slight resistance on the bottle is felt.

In light of the flexibility of the sponge, the opening, as well as the cavity, may also be a notch or incision which, by deforming, makes it possible to insert the tip of the liquid bottle in the heart of the sponge, the deformation of the mass of the sponge creating a cavity in that case.

Depending on the number of cavities considered for the sponge, the cavity or cavities may emerge on one or more surfaces of the sponge. As illustrated in the figures, the opening may emerge on one of the cleaning surfaces of the sponge to facilitate access thereto or to offer an intuitive use for the user.

According to one advantageous embodiment, one of the openings emerges on one of the side faces of the sponge such that the user can refill the sponge with liquid with a second hand and without changing his grip on the sponge with the first hand. An opening on one of the side faces also makes it possible to position the cavity more deeply or as a through cavity when a specific use is considered requiring a greater volume of detergent product, for example when cleaning an oven or pans. This embodiment also makes it possible to benefit from the full cleaning surface of the main faces of the sponge without needing to have holes in the surfaces. The lateral positioning of the opening also imparts better strength to the sponge when it is used than if it were situated on one of the cleaning faces.

Additionally, the shape of the contour of the opening can vary from one sponge to the next. It is preferably circular, but may also have an oval or rectangular shape. It may also be a notch or incision.

According to another embodiment, the sponge according to the invention comprises several layers optionally made from a different material from the main sponge. These additional layers may be added by gluing to the main sponge. It is thus possible to multiply the functionalities of the final sponge, for example by adding a scouring face capable of cleaning encrusted items, or a face capable of wiping surfaces, etc. Typically, the sponges according to the present invention may be covered over at least one of the surfaces by one or more additional layers. According to one preferred embodiment of the invention, the sponge comprises an additional layer covering one or both main surfaces of the sponge.

Typically, additional layers with a base of cellulosic materials, cellulosic tissues, polyurethane foams, open cell honeycomb materials, hydrophilic honeycomb materials, honeycomb materials with a base of a vinyl acetate polymer, microfiber-based or melamine materials may be used. Such materials are known by those skilled in the art and directly applicable to the present invention.

One particularly preferred embodiment of the invention relates to a three-layer sponge, i.e., comprising an additional layer on each of the main surfaces of the sponge which can have different functions, one abrasive and the other having absorbent or degreasing properties. The layers made from a microfiber-based material are in particular advantageous for their absorbent and degreasing and/or wiping properties. This type of structure is particularly effective to complete the anti-grease performance of a liquid detergent and help eliminate certain stains on dishes, such as traces of lipstick on glasses. The outer layers also make it possible to improve the retention of the liquid inside the sponge, further limiting product loss during use while increasing foam production on all of the free faces of the sponge.

Typically, single- or multi-layer sponges according to the invention have a compressive strength at 40% measured according to standard ISO3386 comprised between 1 and 7 kPa, and preferably between 3 and 5 kPa.

Also, the sponge has a retention capacity greater than 20 g/100 $cm^3$, preferably greater than 30 g/100 $cm^3$ as measured after saturation of the sponge after pressure underwater, then wringing out on a plane inclined at 45° for one minute per difference related to the volume of the sponge the weight of the sponge once wrung out with the initial dry value. The sponges according to the present invention remain particularly useful despite the presence of openings.

Owing to the sponges according to the invention, the user henceforth has the possibility of refilling the sponge with a sufficient quantity of liquid soap to clean dishes without any waste or overconsumption. The use of the sponge to clean several surfaces or dishes between refills makes it possible to avoid continuously saturating the sponge and offers considerable dish soap savings.

Furthermore, the sponge according to the invention generates considerable foam, distributed over all of the available surfaces of the sponge, and not in a localized manner, which allows the user to verify visually whether detergent liquid remains that is capable of cleaning the surface or items to be washed. Thus, the user is not encouraged to refill the sponge regularly or to add liquid in the wash medium.

The user henceforth has a visual indicator that makes it possible to refill the sponge with a consistent quantity of dishwashing liquid. It is also possible for the user to insert the tip of the cleaning liquid bottle directly into one of the openings and to fill it using simple pressure on the bottle.

These advantages are particularly useful when the dishwashing is done under running water and makes it possible to reduce liquid soap consumption and, at the same time, to optimize the properties of the product used relative to the use of the sponges of the prior art.

EXAMPLES

Example 1

Sponge Production According to the Invention

Other features and advantages of the invention will appear upon reading other embodiments of the invention, provided as an example and in reference to the appended drawings.

One example of a sponge according to the invention and made up of several layers is illustrated as follows:

- a first layer and a second layer glued to each other, the bottom of the cavity being situated in the first layer;
- the opening is situated on a free surface of the first layer;
- a third layer glued to the first layer, the first, second and third layers forming a sandwich structure;
- the opening is situated on the third layer;
- the second layer and/or the third layer, if applicable, are made from an abrasive material;
- the first layer is made from a porous material and includes closed pores, preferably between 3% and 5% closed pores;
- the first layer is hydrophilic;
- the first layer is made from polyurethane foam;
- the second layer and, if applicable, the third layer are made from one of the following materials: cellulosic sponge, cellulosic tissue, polyurethane foam, an open pore honeycomb material, a hydrophilic honeycomb material, a honeycomb material with a base of vinyl acetate polymer, and a microfiber-based material;
- some or all of the first, second and third layers is glued using impermeable glue, preferably a polyurethane-based glue.

FIGS. 1 to 6 diagrammatically show different sponges according to the invention. In the figures, identical elements or elements with identical functions bear the same reference.

As indicated in FIGS. 1 to 6, a sponge 20 includes a cavity 22 distinct from the pores (not shown) of the sponge 20. The cavity 22 may in particular be made by removing material from the sponge 20, in particular by drilling, boring or milling.

Additionally, the cavity 22 includes a bottom 24 positioned inside the sponge 20. The bottom 24 of the cavity 22 can particular be located at the center of the sponge 20. The cavity 22 also emerges on a free surface 26 of the sponge 20 forming an opening 28. The term "contour" used here also corresponds to the edge or the rim of the opening 28 on the free surface 26 of the sponge 20. The contour corresponds to the ridge formed on the free surface 26 of the sponge 20 by the opening 28.

The contour of the opening 28 on the free surface 22 is such that the maximum distance between two points of the contour of the opening 28 is comprised between 3, preferably 5, still more preferably 8, and 20 mm, preferably 15 mm. In other words, over all of the points of the contour, the maximum distance between two points of that contour is comprised between 3 and 20 mm.

A user of the sponge 20 can thus introduce dishwashing product directly inside the sponge 20 through the opening 28. The dishwashing product passes through the sponge 20 by means of the cavity 22 up to the bottom 24 of the cavity 22. The cavity 22 then has a function of guiding the dishwashing liquid toward the inside of the sponge. A large part of the dishwashing product poured into the cavity 22 is then stored in the pores of the sponge 20 situated close to the bottom 24 of the cavity 22. These pores, situated at the heart of the sponge 20, distribute the dishwashing liquid more gradually than the pores situated near the surface of the sponge 20 (which tend to empty in contact with water). Subsequently, the sponge 20 produces foam during a longer time than a sponge wetted with dishwashing product only on the surface. Subsequently, the user is not inclined to refill the sponge 20 with dishwashing liquid as regularly as with a traditional sponge. The effectiveness of the dishwashing soap and the sponge 20 perceived by the user is thus improved.

Furthermore, the cavity 22 may have a dosing function. In fact, when the cavity 22 is filled with the dishwashing product, the opening 28 becomes a visual indicator for the user of the filling of the cavity 22.

The opening 28, and more generally the transverse cross-section of the cavity 22, may be circular. In that case, the maximum distance between two points of the contour of the opening 28 is the diameter of the opening 28.

The sponge 20, shown in FIG. 1, is, however, of the "dual-layer" type. The sponge 20 in fact includes a first layer 36 and a second layer 38 stacked one on the other.

The first layer 36 is made from a porous material.

The second layer 38 is made from one of the following materials: cellulosic sponge, cellulosic tissue, polyurethane foam, an open pore honeycomb material, a hydrophilic honeycomb material, a honeycomb material with a base of a vinyl acetate polymer, a microfiber-based material and a scouring material. When the second layer 38 is designed to have a scouring function, it may be made from a structure with a base of natural or artificial nonwoven fibers, reinforced and combined with abrasive grains. The second layer 38 may also be made by knitted or woven layers with a base of threads or bands of plastic or metal materials. The second layer 38 may also be made from flexible material impregnated on the surface with hard elements, using adhesive elements or a thermosetting paste.

The second layer 38 is glued to the first layer 36, in particular using an impermeable glue, for example a polyurethane-based glue.

In the case of FIG. 1, the bottom 24 of the cavity 22 is situated in the first layer 36. The surface 26 here is a free surface of the first layer 36, opposite the surface of the first layer 36 glued to the second layer 38. Alternatively (not shown), the cavity 22 may emerge at the second layer 38 and not at the first layer 36.

The cavity 22 extends, in the case of FIG. 1, in a direction perpendicular to the free surface 26. The cavity 22 cylindrical. The cavity 22 may have a circular transverse cross-section. The shape of the cavity 22 is easier to produce. The cavity 22 may in particular be produced using a drill.

The sponge 20 of FIG. 2 differs from the sponge 20 of FIG. 1 essentially in that it includes two cavities 22 that make it possible to impregnate the sponge 20 with the dishwashing liquid more homogenously. In the case of FIG. 2, the cavities 22 are also inclined relative to the free surface 26 of the first layer 36.

Figure 3:
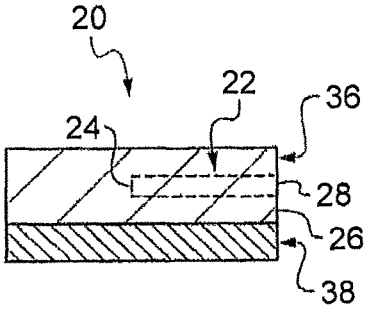

The sponge 20 of FIG. 3 differs from the sponge 20 of FIG. 1 essentially in that the cavity 22 emerges on a free surface 26 that is not a larger surface area of the sponge 20. In other words, the cavity 22 emerges on a surface of the sponge 20 that is not a working surface of the sponge 20, put in contact with the dish.

Figure 4:
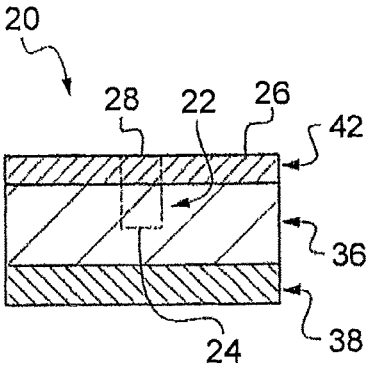

The sponge 20 shown in FIG. 4 differs from the sponge 20 of FIG. 1 in that it is a sponge of the "three-layer" type. The sponge 20 of FIG. 4 thus includes a third layer 42 stacked on the first layer 36. The third layer 42 can be made from a material identical to the second layer 38 or any other material proposed for the second layer 38.

The first, second and third layers 36, 38 and 42 form a sandwich structure where the third layer 42 is positioned on the first layer 36 across from the second layer 38. In that case, the free surface 26 is a surface of the third layer 42. In other words, the cavity 22 emerges at the third layer 42.

The cavity 22 has a geometry identical to that shown in FIG. 1.

The sponge 20 of FIG. 5 differs from the sponge 20 of FIG. 4 in that it includes two cavities 22 distributed over the length of the sponge 20, so as to make it possible to impregnate the sponge 20 with dishwashing liquid more homogenously.

The sponge 20 of FIG. 6 differs from the sponge of FIG. 4 in that it includes two cavities 22 that emerge on free surfaces 26 of the first layer 36, and not on the free surface of the second or third layer 38 or 42. In the case at hand, the cavities 22 emerge on opposite surfaces of the first layer 36. Furthermore, one cavity 22 is perpendicular to the free surface 26 where it emerges. The other cavity 22 is inclined relative to the free surface 26 on which it emerges.

Example 2

A Protocol for Evaluating the Foaming Power of a Sponge

The test described below makes it possible to compare the foaming power of sponges that are impregnated with a same quantity of a same detergent.

Figure 7:
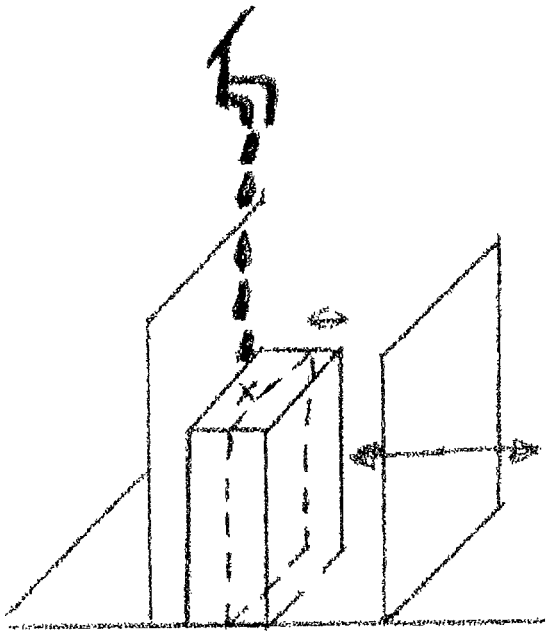
FIG. 7 corresponds to the assembly used in example 2 to measure the foam generation of a sponge.

The test is carried out using a compression device made up of two parallel walls between which the sponge to be tested is placed and whereof one wall is movable so as to compress the sponge in the direction of the thickness at a compression rate set at 50% of the initial thickness. One of the two walls is pierced with holes making it possible to discharge the liquid in compression mode. FIG. 7 diagrams the assembly used for the test.

At the beginning of the test, the sponge is positioned upright on a horizontal bottom (sink, for example) provided with a water outlet, and one of its main faces remains alongside the fixed wall of the press during the test. The side faces of the sponge are free.

The sponge to be tested is first impregnated with a reference detergent. A reference quantity of 50 g of a detergent solution diluted at 1/25 (i.e., incorporation of 2 g of concentrated detergent). First, it is necessary to have the solution homogenously penetrate the sponge by applying several moderate manual pressures (while avoiding any liquid overflows). Then, the formation of foam is measured by compressing the sponge under a continuous stream of softened water at a flow rate equal to 2 l/min positioned above the center of the upper face of the sponge.

In the present example, a detergent whereof the foaming power, measured according to standard ISO 696:1975 measured at 20° C. instead of 50° C., is 160 mL after 30 seconds, 154 mL after 3 minutes and 152 mL after 5 minutes, is used to test sponges measuring 160×130×40 mm. The test is then done using the following protocol:

the sponge is placed in the vertical position in the press.

the stream of water is run (which will be kept continuously on the sponge during the test) and immediately after:

1) The sponge is compressed, then released for approximately 3 s.
2) One waits approximately 12 s.

The cycle 1) & 2) is repeated 9 more times, every 15 s.

At the end of the 15th second of the 10th cycle, the sponge is removed, then the solution it contains is extracted by manual pressing on the bottom, so as to collect it in a graduated test tube (using a funnel).

30 s after the end of the last cycle, the volume of foam is measured that emerges above the water in the test tube.

The minute-by-minute sequence of the operations under the uninterrupted stream of water corresponds to the following sequence:

t=00 s: Compression no. 1. Pressure release after approximately 3 s.

t=15 s: Compression no. 2. Pressure release after approximately 3 s.

t=30 s: Compression no. 3. Pressure release after approximately 3 s.

t=45 s: Compression no. 4. Pressure release after approximately 3 s.

t=1 m 00 s: Compression no. 5. Pressure release after approximately 3 s.

t=1 m 15 s: Compression no. 6. Pressure release after approximately 3 s.

t=1 m 30 s: Compression no. 7. Pressure release after approximately 3 s.

t=1 m 45 s: Compression no. 8. Pressure release after approximately 3 s.

t=2 m 00 s: Compression no. 9. Pressure release after approximately 3 s.

t=2 m 15 s: Compression no. 10. Pressure release after approximately 3 s.

t=2 m 30 s: Removal of the sponge and manual pressure on the bottom above a graduated test tube.

T=3 m 00 s: Measurement of the volume of foam produced.

The measurement represents the ratio between the volume of foam generated after 10 compressions and the volume of the sponge, in percentage.

The invention claimed is:

1. A method in which a user manipulates a sponge (20), wherein said sponge is foam-generating and includes at least one cavity (22), distinct from the pores of the sponge (20), capable of allowing the introduction of a dishwashing liquid inside the sponge (20) to impregnate the sponge (20), the cavity (22) having a bottom (24) inside the sponge (20), and emerging on the other hand on a surface (26) of the sponge (20) while forming an opening (28) such that the maximum distance between two points of the contour of the opening (28) is comprised between 3 and 25 mm, and wherein a large part of a dishwashing liquid poured into the cavity (22) is then stored in the pores of the sponge (20) situated close to the bottom (24) of the cavity (22), wherein a volume of at least 90% of the dishwashing liquid is absorbed in the sponge (20), wherein the user releases a quantity of dishwashing liquid by compressing said sponge (20), whereby foam is generated, and wherein the sponge has an absorption speed of a reference volume of 2 ml of a dishwashing liquid with the viscosity of 900 cps at 25° C. deposited on the surface of the sponge with a volume of 140 $cm^3$ and previously moistened with water, of less than 5 minutes.

2. The method according to claim 1, wherein the user reloads the sponge (20) with a dishwashing liquid during a cleaning phase.

3. The method according to claim 1, wherein the cleaning is implemented under running water.

4. The method according to claim 1, wherein the user introduces a constant volume of dishwashing liquid in the cavity (22) of the sponge (20).

5. The method according to claim 4, wherein a tip of a bottle containing the dishwashing liquid is inserted directly into the opening.

6. The method according to claim 1, wherein a tip of a liquid bottle creates a hermetic contact area with the cavity of the sponge, by deforming the opening during the insertion of the tip of the dishwashing liquid bottle.

7. The method according to claim 1, wherein the sponge has a water retention capacity greater than 20 g/100 $cm^3$, as measured after saturation of the sponge, after pressure is applied underwater, and after wringing out on a plane surface inclined to 45° for one minute.

8. The method according to claim 1, wherein the size of the opening (28) prevents the dishwashing liquid introduced into the cavity by the user from leaving before it has impregnated the inside of the sponge.

9. The method according to claim 1, wherein the entire structure sponge generates and then favors the formation of foam.

10. The method according to claim 1, wherein the dishwashing liquid is contained in the very structure of the sponge and comes out in the form of foam from all of the available surfaces of the sponge during cleaning.

11. The method according to claim 1, wherein the sponge comprises a porous material having between 2 and 20% closed pores.

12. A method of manipulating a sponge, the sponge being foam-generating, the sponge comprising at least one cavity that is distinct from any pores on the sponge, the at least one cavity comprising a bottom located inside the sponge and an opening located on a surface of the sponge, and the maximum distance between the bottom and the contour of the opening is between 3 and 25 mm, wherein the opening is configured to receive dishwashing liquid and allow a quantity of dishwashing liquid to impregnate the inside of the sponge, the at least one cavity is configured to guide the dishwashing liquid toward the inside of the sponge, the sponge being configured so dishwashing liquid penetrates the inside structure of the sponge, wherein a volume of at least 90% of the dishwashing liquid is absorbed in the sponge, and the sponge having a water retention capacity greater than 20 g/100 $cm^3$, as measured after saturation of the sponge, after pressure is applied underwater, and after wringing out on a plane surface inclined to 45° for one minute;

the method comprising:

pouring a dose of dishwashing liquid into the at least one cavity to impregnate the sponge, manipulating the sponge so the dishwashing liquid penetrates the inside structure of the sponge, wherein a volume of at least 90% of the dishwashing liquid is absorbed in the sponge, and compressing the sponge to generate a foam from the absorbed dishwashing liquid.

13. The method according to claim 12, further comprising: pouring an additional dose of dishwashing liquid into the cavity during the cleaning.

14. The method according to claim 12, wherein a tip of a bottle containing dishwashing liquid creates a hermetic contact area with the cavity of the sponge.

15. The method according to claim 12, wherein the sponge has a compressive strength between 3 and 5 kPa when measured according to ISO-3386.

16. The method according to claim 12, wherein the sponge has an absorption speed of a reference volume of 2 ml of a dishwashing liquid with the viscosity of 900 cps at 25° C. deposited on the surface of the sponge with a volume of 140 $cm^3$ and previously moistened with water, of less than 5 minutes.

17. The method according to claim 12, wherein the size of the opening prevents the dishwashing liquid introduced into the cavity by the user from leaving before it has impregnated the inside of the sponge.

18. The method according to claim 12, wherein the entire structure of the sponge generates and then favors the formation of foam.

19. The method according to claim 12, wherein the dishwashing liquid is contained in the very structure of the sponge and comes out in the form of foam from all of the available surfaces of the sponge during cleaning.

20. A method of manipulating a sponge, the sponge being foam-generating, the sponge comprising at least one cavity that is distinct from any pores on the sponge, the at least one cavity comprising a bottom located inside the sponge and an opening located on a surface of the sponge, and the maximum distance between the bottom and the contour of the opening is between 3 and 25 mm, wherein the opening is configured to receive dishwashing liquid and allow a quantity of dishwashing liquid to impregnate the inside of the sponge, the at least one cavity is configured to guide the dishwashing liquid toward the inside of the sponge, the sponge having an absorption speed of a reference volume of 2 ml of a dishwashing liquid with the viscosity of 900 cps at 25° C. deposited on the surface of the sponge with a volume of 140 $cm^3$ and previously moistened with water, of less than 2 minutes;

the method comprising:

pouring a dose of dishwashing liquid into the cavity to impregnate the sponge, manipulating the sponge so the dishwashing liquid penetrates the inside structure of the sponge, wherein a volume of at least 90% of the dishwashing liquid is absorbed in the sponge, and compressing the sponge to generate a foam from the absorbed dishwashing liquid.

21. The method according to claim 20, further comprising: pouring an additional dose of dishwashing liquid into the cavity during the cleaning.

22. The method according to claim 20, wherein the size of the opening prevents the dishwashing liquid introduced into the cavity by the user from leaving before it has impregnated the inside of the sponge.

23. The method according to claim 20, wherein the entire structure of the sponge generates and then favors the formation of foam.

24. The method according to claim 20, wherein the dishwashing liquid is contained in the very structure of the sponge and comes out in the form of foam from all of the available surfaces of the sponge during cleaning.

* * * * *